US005221320A

United States Patent [19]

Sinha

[11] Patent Number: 5,221,320

[45] Date of Patent: Jun. 22, 1993

[54] CONTROLLING DEPOSITS IN THE CALCINATION OF FLUXED IRON ORE PELLETS

[75] Inventor: Rabindra K. Sinha, Coraopolis, Pa.

[73] Assignee: Calgon Corporation, Pittsburgh, Pa.

[21] Appl. No.: 876,243

[22] Filed: Apr. 30, 1992

[51] Int. Cl.[5] ..... C22B 1/02

[52] U.S. Cl. ..... 75/301; 75/763; 75/768

[58] Field of Search ..... 75/301, 751, 760, 761, 75/762, 763, 768, 769; 110/343; 44/640

[56] References Cited

U.S. PATENT DOCUMENTS 2,845,338 7/1958 Ryznar et al. ..... 44/640
3,404,099 10/1968 Steinmetz .
4,372,782 2/1983 Salter et al. .
4,503,019 3/1985 Sinha .
4,510,807 4/1985 Tokutake et al. ..... 266/99
4,561,897 12/1985 Zupanovich et al. .

*Primary Examiner*—Melvyn J. Andrews
*Attorney, Agent, or Firm*—Raymond M. Speer; Charles M. Caruso

[57] ABSTRACT

A stable aqueous suspension of a mixture of magnesium hydroxide and copper oxychloride, together with a suspending agent, is used to reduce deposits in kilns or furnaces used to make iron ore agglomerates, known as pellets, during a calcination process in which iron ore fines mixed with fluxing materials having a phosphate content of less than 1% by weight of the total flux and iron ore weight, are heated to from about 900° to about 1400° C. in order to create the hardened iron ore pellets, called flux pellets, one of the chief raw materials in steel making.

9 Claims, No Drawings

CONTROLLING DEPOSITS IN THE CALCINATION OF FLUXED IRON ORE PELLETS

BACKGROUND OF THE INVENTION

1. Field of the Invention

The present invention relates to compositions and methods for inhibiting deposits during calcination of fluxed iron ore pellets in which the fluxing materials have a phosphate content of less than 1% by weight of the total weight of fluxing material and iron ore.

Crude iron ore cannot be used directly in the steel making process, but must first be concentrated and refined. When the iron content of the ore is increased, the process generally is referred to as concentration, and this can sometimes be accomplished simply by crushing, screening, and washing. Other times, the ore is ground to very small particles before the iron oxides can be separated from the rest of the material, called gangue, which is normally accomplished by magnetic drums.

However, even where there is satisfactory concentration, iron ore consisting of fine particles is undesirable as blast-furnace feed; the iron ore particles must first be agglomerated into a coarser form, and this process is referred to as agglomeration. The most desirable size for blast-furnace feed is from 6–25 mm, and pelleting is one of the methods frequently used to achieve this type of coarse iron ore feed.

In the pelletizing process, which accounts for about two-thirds of U.S. agglomerate production, the ore must be ground to a very fine size, less than 75 μm. The ground ore is mixed with the proper amount of water, and sometimes with a small amount of bentonite, and this is rolled into small balls 10–20 mm in diameter in a balling drum or disk. These green pellets are dried, then are heated to 1200°–1370° C. to bond the small particles, and finally are cooled. The heating can be done on a traveling grate, or in a shaft furnace, or by a combination of a traveling grate and a rotary kiln.

Another of the chief raw materials in the steel making process in addition to the iron ore, is the fluxing material consisting of lime ($CaCO_3$) and/or dolomite ($CaCO_3$-$MgCO_3$). Typically, limestone is crushed and screened to the desired particle size, and burnt lime for steel making is then prepared from the limestone by calcination in a long rotary kiln. It is common to combine the iron ore pelletizing operation described above with the limestone and/or dolomite flux preparation and calcination by adding the limestone and/or dolomite particles directly to the iron ore particles which are to be formed into pellets. This mixture is then heated in the same device, usually a long rotary kiln, often with a traveling grate, so that the pelletizing and limestone and/or dolomite calcination are accomplished in the same step and in the same heating furnace. This combined step is usually referred to as calcination of the iron ore, although the chief result is the hardening of the green iron ore pellets.

During the heating of the mixture of particles of limestone and/or dolomite flux and particles of iron ore formed into pellets, which will be referred to as flux pellet kilning, a problem is frequently encountered involving deposits which form on the walls of the rotary kiln or other furnace or heating device being used. These deposits are formed as a result of the flux pellet kilning operation, perhaps as the result of a combination of mechanical adhesion and condensation on the cooler skin of the kiln or furnace surface. The predominant constituent of such deposits is ferric oxide (hematite), with the majority of the remainder being magnetic iron oxide (magnetite). However, there is frequently a significant amount, about 2–10% by weight of the total deposit, of calcium phosphate, $Ca_{10}(PO_4)_6(OH)_2$ (hydroxyapetite).

Such deposits create substantial problems in the kilning operation, e.g., by forming a barrier which resists the transfer of heat, thus reducing the efficiency and thereby increasing the heating time required. Also, large portions of such deposits can break away and become admixed with the pellets being calcined, thus resulting in an unacceptable final product. As a result of the formation of these deposits, significant removal problems are created.

For example, there is a significant down time for the kilns, furnaces or other heating devices being used, during which the deposits are mechanically removed by such off-line cleaning methods as compressed air driven jack-hammers, small charges of blasting explosives, or more time-consuming approaches utilizing hammers and chisels, etc. These processes of mechanical removal present serious problems in addition to the down time which they entail. An on-line method of cleaning which is frequency used involves mechanical removal of these deposits by "shooting", in which the deposits are blasted away by repeated discharging of shotguns against the deposits. This procedure poses the obvious risks to the personnel performing it, but also has been known to result in serious damage to the walls of the kiln or other furnace heating device being used.

In order to significantly inhibit the formation of these flux pellet kiln deposits, and thereby significantly increase the efficiency of the flux pellet kilning operation, the present invention provides for the administration in liquid form of a stable aqueous suspension of a combination of magnesium hydroxide and copper oxychloride, together with a suspending agent, described in detail further below, to the flux pellet kilning operation.

However, it has been found that the method of the present invention will not satisfactorily inhibit deposits in the flux pellet kilning operation where the flux being used has too high a phosphate content. Analysis of deposits, particularly with respect to the presence of high amounts of calcium phosphate (hydroxyapetite), and correlation thereof with unsatisfactory inhibition, has led to the discovery that a critical limitation for preventing such deposits is that the phosphate content, as $P_2O_5$, must be less than 1% by weight of the total weight of the flux pellet, i.e., the combined weight of iron ore and flux material.

2. Brief Description of the Prior Art

The use of copper oxychloride to inhibit deposit formation is disclosed in Kiss, L. T., et al., "The Use of Copperoxychloride to Alleviate Boiler Slagging", *Journal of the Institute of Fuel*, April 1972, pages 213–223.

U.S. Pat. No. 2,845,338 discloses the use of blends of magnesium oxide and copper oxychloride to inhibit deposits in coal-fired boiler furnaces. The principal deposits are CaO (generally less than 10%), $SiO_2$, $Al_2O_3$, and $Fe_2O_3$.

U.S. Pat. No. 3,404,099 describes making of catalyst compositions by precipitating iron oxychloride and then calcining it.

U.S. Pat. No. 4,372,782 describes production of high grade lead and silver involving treatment with brine and lime to produce oxychlorides followed by calcination.

U.S. Pat. No. 4,503,019 discloses the use of blends of magnesium oxide and copper oxychloride for inhibiting and dispersing calcium oxide deposit formation in coal-fired kilns.

U.S. Pat. No. 4,561,897 describes an aqueous magnesium hydroxide suspension dispersible in oil, and used to inhibit corrosion in fuel burning boilers.

Blends of magnesium hydroxide and copper oxychloride have been used to prevent deposit formation in ordinary unfluxed iron ore pelletizing operations, but not successfully to flux pellet kilning.

None of the above applications in any way suggest the compositions and methods of the present invention.

SUMMARY OF THE INVENTION

The present invention relates to a method of inhibiting the formation of iron oxide containing deposits on the surfaces of heating devices during fluxed iron ore pellet calcination, comprising the step of treating the atmosphere of said heating device in which said calcination takes place with a deposit-inhibiting amount of a stable aqueous suspension comprising from 40 to 55% by weight of magnesium hydroxide, from 1 to 2.5% by weight of copper oxychloride; from 1 to 10% by weight of an alkyl benzene sulfonate suspending agent; and the remainder water;

provided that the phosphate content, as $P_2O_5$, of the flux in said fluxed iron ore pellet is less than 1% by weight of the total weight of flux and iron ore in said pellets.

In particular, the present invention relates to such a method wherein the heating device which is employed is a rotary kiln, and the aqueous solution of magnesium hydroxide and copper oxychloride is injected into said kiln as a fine mist at the rate of 0.1 to 5 gallons per hour (gph) for every 5000 ton per day capacity of said kiln.

The present invention further relates to a composition for inhibiting the formation of iron oxide containing deposits on the surfaces of heating devices during fluxed iron ore pellet calcination, comprising a stable aqueous suspension containing from 40 to 55% by weight of magnesium hydroxide, from 1 to 2.5% by weight of copper oxychloride; from 1 to 10% by weight of an alkyl benzene sulfonate suspending agent; and the remainder water;

provided that the phosphate content, as $P_2O_5$, of the flux in said fluxed iron ore pellet is less than 1% by weight of the total weight of flux and iron ore in said pellets.

DETAILED DESCRIPTION OF THE INVENTION

In accordance with the present invention, there are provided compositions for inhibiting the formation of iron oxide containing deposits on the surfaces of heating devices during fluxed iron ore pellet calcination, comprising a stable aqueous suspension containing from 40 to 55% by weight of magnesium hydroxide, from 1 to 2.5% by weight of copper oxychloride; from 1 to 10% by weight of an alkyl benzene sulfonate suspending agent; and the remainder water;

provided that the phosphate content, as $P_2O_5$, of the flux in said fluxed iron ore pellet is less than 1% by weight of the total weight of flux and iron ore in said pellets.

The compositions of the present invention are aqueous suspensions, since it has been found that the most effective, efficient and economical means of applying the mixture of active ingredients, i.e., the magnesium hydroxide and the copper oxychloride, is by dispersing a stable aqueous suspension thereof by way of spray or mist into the atmosphere of the heating devices which are utilized during fluxed iron ore pellet calcination. Preferably, a fine mist is employed, which may be achieved by atomizing the aqueous suspension utilizing compressed air or steam. Such methods of application and the apparatus necessary for carrying them out are well within the ordinary skill of the art.

The amounts of the active ingredients which are contained in the aqueous suspension are within the ranges: 40 to 55% by weight of magnesium hydroxide, and 1 to 2.5% by weight of copper oxychloride, based on the total weight of the aqueous suspension. Preferably, the amount of magnesium hydroxide will be within the range of from 42 to 51% by weight of the total aqueous suspension. The amount is somewhat variable due to the method of preparation of the magnesium hydroxide slurry employed, which will be explained in more detail further below. The amount of copper oxychloride will preferably be about 1.5% by weight, based on the total weight of the aqueous suspension.

The two active ingredients are, in fact, sparingly soluble in water, so that aqueous solutions of these materials would be unable to provide sufficient amounts of the active ingredients to be useful in preventing iron oxide containing deposits.

Because of this low degree of water solubility, it is necessary in accordance with the present invention to provide aqueous suspensions of the active ingredients. This is achieved by the use of an alkyl benzene sulfonate suspending agent. Any alkyl benzene sulfonate may be used. Examples include isopropylamine dodecyl benzene sulfonate, which is preferred, sodium dodecyl benzene sulfonate, ammonium dodecyl benzene sulfonate, triethanolamine dodecyl benzene sulfonate, tridecyl benzene sulfonic acid, dodecyl benzene sulfonic acid, and the like. The amount of alkyl benzene sulfonate suspending agent which is utilized will be within the range of from 1 to 10%, preferably from 2 to 8% by weight of the total weight of the aqueous suspension. Usually, the amount will be about 5% by weight when the preferred amounts of the active ingredients are employed, but selection of the amount depends upon the amounts of active ingredient involved and is well within ordinary skill to determine.

The magnesium hydroxide used in preparing the aqueous suspension compositions of the present invention may be obtained by conventional reactions such as treating sea water or salt water containing magnesium chloride with an alkali, for example, quick lime or lightly calcined dolomite. Magnesium hydroxide normally remains in a slurry until concentrated to about 35% by weight, and further concentration is possible by such means as spontaneous sedimentation, filtration or centrifugal separation. Concentration to a higher degree is also possible by addition of dry powders to the slurry or, in the alternative, by the addition of water to the dry powders. Further details may be found in U.S. Pat. No. 4,561,897.

It is usually desirable to employ an antifoaming agent in the aqueous suspension compositions of the present invention, in order to eliminate any foaming and to modify the viscosity, although this is not necessary.

Examples of useful antifoaming agents include polydimethyl siloxane, and polydimethyl siloxane with silica.

It is possible to apply the stable aqueous suspension compositions of the present invention described above to the heating device in which calcining of the fluxed iron ore pellets is taking place, e.g., a rotary kiln, directly in a neat condition, i.e., without diluting it with water. However, it has been found that this will make atomization of misting of the aqueous suspension composition difficult, and that it will be difficult to apply optimum and not excessive amounts of the active ingredients because they exist in a concentrated form in the aqueous suspension. Thus, it is preferred to dilute the aqueous suspension with water in a range of ratios of suspension to water of from about 1:1 to about 1:20, preferably from about 1:2 to about 1:10, most preferably about 1:5. However, it should be noted that the ranges of application amounts indicated throughout the instant specification are for the stable aqueous suspension composition in neat, i.e., undiluted form.

The rate of application of the aqueous suspension compositions of the present invention will be within the range of from about 0.1 to about 5 gallons per hour (gph), preferably from about 0.5 to 2 about gph, and most preferably from about 0.75 to about 1.5 gph, all of which dosage amounts are for every 5000 tons per day capacity of the heating device, e.g., a rotary kiln, that is used to carry out the fluxed iron ore pellet calcination.

As has already been alluded to further above, the compositions and methods of the present invention have diminished usefulness where the phosphate content, as $P_2O_5$, of the flux used in the fluxed iron ore pellet calcination process is less than 1% by weight of the total weight of flux and iron ore in said pellets being calcined. The reasons for this are not clear, but presumably, the phosphate enters into a chemical reaction with the magnesium hydroxide and/or the copper oxychloride and renders one or both of them unable to prevent deposits during the calcination process. Consequently, it is a limitation of the present invention that the phosphate content, as $P_2O_5$, must be less than 1% by weight of the total weight of the flux pellet, i.e., the combined weight of iron ore and flux material.

DESCRIPTION OF PREFERRED EMBODIMENT

An aqueous composition of the present invention was prepared by suspending the following active ingredients in the indicated concentrations in water:

| | |
|---|---|
| magnesium hydroxide | 42–51% |
| copper oxychloride | 1.53% |
| isopropylamine dodecyl benzene sulfonate (Witconate ®-P-10-59 suspending agent: Witco Chemical) | 4.75% |
| polydimethyl siloxane (antifoaming agent) | 0.1% |

The above stable aqueous suspension composition was diluted with water in the ratio of 1 part of suspension to 5 parts of water, then applied into the atmosphere of the kiln described further below, using a special lance-type misting device, at the rate of 0.28 gallons per hour (6.6 gallons per day), based on undiluted stable aqueous suspension composition, for each 5000 ton per day capacity of the 21 foot diameter by 140 foot long rotary kiln used to calcine fluxed iron ore pellets in which the phosphate content was less than 1% by weight of the total weight of flux and iron ore in said pellets. It was found that using this treatment, after 24 days there was no build-up of any deposit on the surfaces of said kiln. By contrast, in an adjoining kiln, and during a comparable period, over 2000 firearms rounds were expended in an effort to prevent deposit accumulation, and problems were experienced with large pieces of deposit falling into the fluxed pellets being calcined. Consequently, it was found that the deposit control composition of the present invention prevented deposits in a heating device of industrial size and operated under typical commercial conditions and over an extended period of time; whereas deposit formation and its attendant problems were experienced in a similar heating device operating under the same conditions but having no treatment.

What is claimed is:

1. A method of inhibiting the formation of iron oxide containing deposits on the surfaces of heating devices during fluxed iron ore pellet calcination, wherein the flux therein employed contains phosphate, comprising the step of treating the atmosphere of said heating device in which said calcination takes place with a deposit-inhibiting amount of a stable aqueous suspension comprising from 40 to 55% by weight of magnesium hydroxide, from 1 to 2.5% by weight of copper oxychloride; from 1 to 10% by weight of an alkyl benzene sulfonate suspending agent; and the remainder water;

provided that the phosphate content, as $P_2O_5$, of the flux in said fluxed iron ore pellet is less than 1% by weight of the total weight of flux and iron ore in said pellets.

2. A method according to claim 1 wherein the heating device which is employed is a rotary kiln, and the aqueous suspension is diluted with water at a suspension to water ratio of from about 1:2 to about 1:10, and is injected into said kiln as a fine mist at the rate of from about 0.1 to about 5 gallons per hour (gph) based on undiluted aqueous suspension, for every 5000 ton per day capacity of said kiln.

3. A method according to claim 2 wherein the amount of magnesium hydroxide in the aqueous suspension composition is from 42 to 51% by weight, the amount of copper oxychloride is about 1.5% by weight, and the amount of alkyl benzene sulfonate suspending agent is about 5%.

4. A method according to claim 3 wherein the suspending agent is isopropylamine dodecyl benzene sulfonate.

5. A method according to claim 2 wherein the dilution ratio is 1:5, the rate of application is from about 0.75 to about 1.5 gph based on undiluted aqueous suspension.

6. A composition for inhibiting the formation of iron oxide containing deposits on the surfaces of heating devices during fluxed iron ore pellet calcination wherein the flux therein employed contains phosphate, comprising a stable aqueous suspension containing from 40 to 55% by weight of magnesium hydroxide, from 1 to 2.5% by weight of copper oxychloride; from 1 to 10% by weight of an alkyl benzene sulfonate suspending agent; and the remainder water;

provided that the phosphate content, as $P_2O_5$, of the flux in said fluxed iron ore pellet is less than 1% by weight of the total weight of flux and iron ore in said pellets.

7. A composition according to claim 6 wherein the amount of magnesium hydroxide in the aqueous suspension composition is from 42 to 51% by weight, the amount of copper oxychloride is about 1.5% by weight, and the amount of alkyl benzene sulfonate suspending agent is about 5% by weight of the total weight of the stable aqueous suspension.

8. A composition according to claim 7 wherein the suspending agent is isopropylamine dodecyl benzene sulfonate.

9. A composition according to claim 6 which is diluted with water in a suspension to water ratio in the range of from about 1:1 to about 1:20 before being applied for inhibition of said iron oxide containing deposits.

* * * * *